US010752392B2

(12) United States Patent
Kuhmichel et al.

(10) Patent No.: US 10,752,392 B2
(45) Date of Patent: Aug. 25, 2020

(54) APPARATUS FOR DELIVERING PRODUCT CARRIERS AND APPARATUS FOR PIVOTING A COVER SECTION OF A PRODUCT CARRIER

(71) Applicant: WEBER MASCHINENBAU GMBH BREIDENBACH, Breidenbach (DE)

(72) Inventors: Christoph Kuhmichel, Bad Laasphe (DE); Thomas Nispel, Dautphetal (DE); Ingo Rother, Breidenbach (DE); Steffen Zecher, Staufenberg (DE); Julia Walsch, Erndtebrück (DE); Andreas Runkel, Biedenkopf (DE)

(73) Assignee: Weber Maschinenbau GmbH Breidenbach (DE)

( * ) Notice: Subject to any disclaimer, the term of this patent is extended or adjusted under 35 U.S.C. 154(b) by 485 days.

(21) Appl. No.: 15/495,623

(22) Filed: Apr. 24, 2017

(65) Prior Publication Data

US 2017/0320606 A1 Nov. 9, 2017

(30) Foreign Application Priority Data

May 3, 2016 (DE) ..... 10 2016 108 213

(51) Int. Cl.
*B65G 15/00* (2006.01)
*B65G 47/90* (2006.01)
(Continued)

(52) U.S. Cl.
CPC ..... *B65B 41/06* (2013.01); *B65B 5/024* (2013.01); *B65B 11/004* (2013.01); *B65B 11/06* (2013.01); *B65B 25/06* (2013.01); *B65B 25/065* (2013.01); *B65B 25/068* (2013.01); *B65B 43/145* (2013.01); *B65B 49/08* (2013.01);
(Continued)

(58) Field of Classification Search
None
See application file for complete search history.

(56) References Cited

U.S. PATENT DOCUMENTS 2,768,492 A 10/1956 Kay et al.
4,003,184 A 1/1977 Shiu
(Continued)

FOREIGN PATENT DOCUMENTS

DE 102010012407 A1 9/2011
DE 102011121642 B3 6/2013
(Continued)

OTHER PUBLICATIONS

Communication received from the German Patent Office; dated Jan. 9, 2017; 2 pages.

*Primary Examiner* — Kavel Singh
(74) *Attorney, Agent, or Firm* — Dickinson Wright PLLC

(57) ABSTRACT

An apparatus for delivering product carriers, in particular L boards, to a conveying line for food products comprises a store for the product carriers and a conveying device for conveying the product carriers, in particular isolated product carriers, along a conveying direction to the conveying line, wherein each product carrier has at least one base section and at least one cover section connected to the base section; and wherein the apparatus comprises a pre-treatment device for the product carriers that is configured to pre-treat the cover section of a product carrier with respect to its base section.

5 Claims, 8 Drawing Sheets

Figure 1:
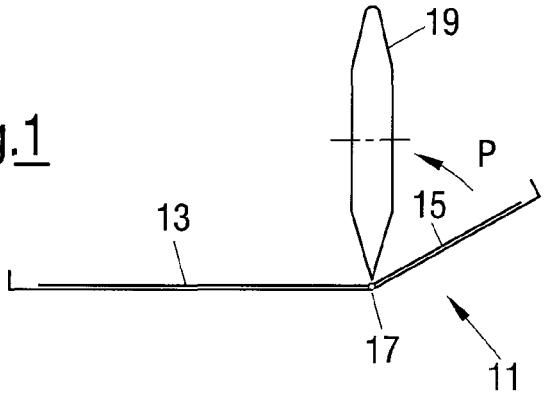

(51) Int. Cl.

| | |
|---|---|
| ***B65G 47/91*** | (2006.01) |
| ***B65B 41/06*** | (2006.01) |
| ***B65B 25/06*** | (2006.01) |
| ***B65B 49/08*** | (2006.01) |
| ***B65B 49/10*** | (2006.01) |
| ***B65B 11/00*** | (2006.01) |
| ***B65B 49/14*** | (2006.01) |
| ***B65B 5/02*** | (2006.01) |
| ***B65B 11/06*** | (2006.01) |
| ***B65B 43/14*** | (2006.01) |
| *B65B 35/50* | (2006.01) |
| *B65B 41/08* | (2006.01) |

(52) U.S. Cl.
CPC ..... *B65B 49/10* (2013.01); *B65B 49/14* (2013.01); *B65B 35/50* (2013.01); *B65B 41/08* (2013.01)

(56) References Cited

U.S. PATENT DOCUMENTS 4,718,540 A * 1/1988 Greenwell ..... B65B 59/02 198/620
5,460,481 A * 10/1995 Prakken ..... B65G 47/082 414/798.2
5,768,857 A 6/1998 Ward et al.
5,996,861 A * 12/1999 Propach ..... D06F 89/02 223/37
6,238,175 B1 * 5/2001 Gotz ..... B65H 3/0816 198/435

FOREIGN PATENT DOCUMENTS

EP 2559625 B1 2/2013
WO 9857852 12/1998
WO 0170578 A1 9/2001

* cited by examiner

Fig.10
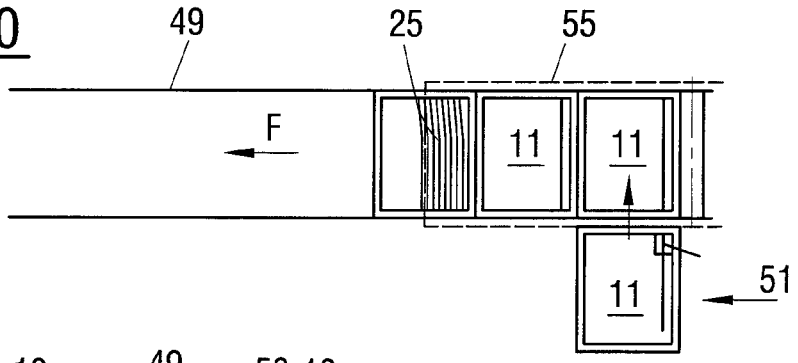
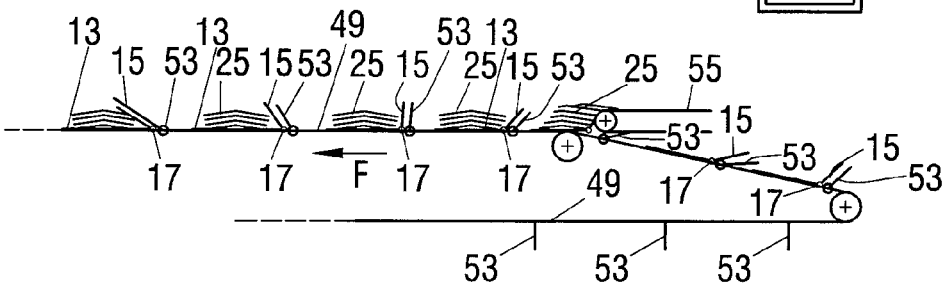
Fig.11
Fig.12
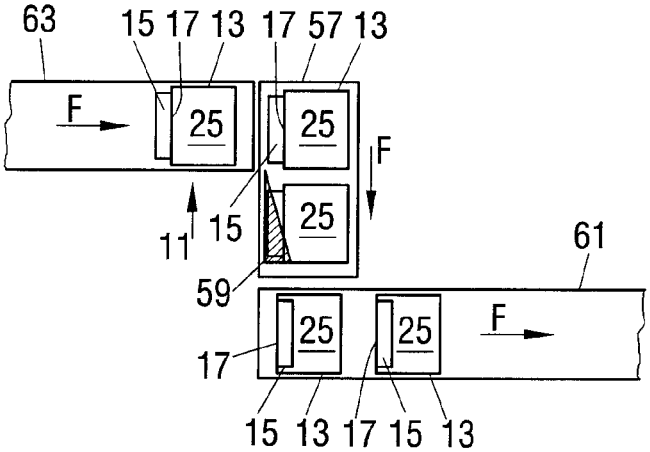

APPARATUS FOR DELIVERING PRODUCT CARRIERS AND APPARATUS FOR PIVOTING A COVER SECTION OF A PRODUCT CARRIER

CROSS REFERENCE TO RELATED APPLICATIONS

This application claims priority to DE102016108213.9, filed 3 May 2016, which is hereby incorporated by reference in its entirety.

The present invention relates to an apparatus for delivering product carriers, in particular L boards, to a conveying line for food products and to an apparatus for pivoting a cover section of a product carrier with respect to a base section connected thereto about a kink line (also known as a folding line) extending between the cover section and the base section.

Product carriers are flat, preferably rectangular, board-like structures, e.g. composed of cardboard or paper, that can be divided into a base section and into a cover section disposed in a marginal region of the product carrier. Provision is made that a food product such as a portion of a food product comprising at least one slice is placed on the base section of a product carrier disposed on a support surface and that the cover section is then pivoted or folded toward the top and to the side in the direction of the base section about a kink line that extends between the base section and the cover section such that the cover section at least partially covers the product.

The product carrier can be delivered together with the product to a packaging machine in which the combination of product carrier and product is packaged. The product is partially covered by the pivoted or folded cover section in the packaging, whereby the presentation of the product is improved.

EP 2 559 625 B1 describes a food processing apparatus for production sections of a food that has a combining apparatus in which the product sections are combined with product carriers that are also called L boards. A product carrier delivery system is configured to combine a respective product carrier of at least two different kinds of product carriers with the product section in dependence on a property of the product sections. The product carrier delivery system has a product carrier feed that provides different kinds of product carriers from different stocks of product carriers in a product carrier store and, when a product section runs past the product carrier feed, provides a product carrier in dependence on the property of the product section that is combined with the product section.

A folding device or a method for machining one or more L boards is known from DE 10 2011 121 642 B3.

It is the underlying object of the invention to provide an improved apparatus for delivering product carriers to a conveyor line for food products and respectively to provide an improved apparatus for pivoting a cover section of a product carrier.

An apparatus in accordance with the invention for delivering product carriers, in particular L boards, to a conveying line for food product comprises a store for the product carriers and a conveying device for conveying the product carriers, in particular isolated product carriers, along a conveying direction to the conveying line. Each product carrier has at least one base section and at least one cover section connected to the base section. The apparatus comprises a pre-treatment device for the product carriers that is configured to pre-treat the cover section of a product carrier with respect to its base section.

The delivery apparatus in accordance with the invention can deliver the pre-treated product carriers to the conveying line and can thus provide them to the conveying line. It can be considered as a kind of dispenser apparatus in whose store the, preferably untreated, product carriers are held in store and in which the product carriers are pre-treated before they are provided to the conveying line. Pre-treatment in particular means that a kink line is introduced into the product carrier, that an already existing kink line is attenuated and/or that the cover section is pivoted at least slightly away from a support for the product carrier about the kink line. The cover section can also be pre-grasped by the pre-treatment device and can in particular be prepared for pivoting about the kink line that extends between the cover section and the base section. The pre-treatment can take place both on the dispensing from a store, i.e. on the isolation, and on the provision path to the conveying line.

The pivoting of the cover section preferably takes place from a first location, in particular a starting location, of the cover section in which the cover section lies in an extension of the base section in the same plane as the base section into a second location, in particular an end location or an intermediate location, in which the cover section is at least slightly pivoted about the kink line extending between the base section and the cover section, e.g. by 5 to 45 degrees, preferably by 5 to 30 degrees, further preferably by 5 to 20 degrees. That position of the cover section is called the end location that said cover section should adopt to cover the product. A position of the cover section is called the intermediate location that is disposed in the pivot range between the starting location and the end location.

As mentioned, the delivery apparatus can be considered as a kind of dispenser device that provides the product carriers in the conveying line. Such a conveying line is, for example, a conveying line that is arranged between a food slicing machine, that is also called a high-performance slicer, and a packaging machine or that is integrated in the slicing machine or packaging machine.

It is in particular advantageous in the apparatus in accordance with the invention for delivering product carriers that said apparatus provides the product carriers with a pre-treated cover section. The further handling of the product carrier is thereby simplified, in particular in the conveying line, above all with regard to a pivoting of the cover section such that the latter at least partially covers a product disposed on the base section of the product carrier.

The food product can be a slice of a food product such as sausage, meat or cheese, or also a portion, for example a stacked portion, of a food product comprising a plurality of slices.

The pre-treatment device can be integrated in the conveying device for conveying the product carriers along a conveying direction to the conveying line. It thereby becomes possible in a simple manner also to use the conveyor line along the conveying device, the movement of the product conveyor along the conveyor line and/or a drive of the conveying device for the pre-treatment of the cover section.

The pre-treatment device is preferably configured to pre-treat the cover section while the product carrier is conveyed by the conveying device. The movement of the product carrier can thus be utilized for the pre-treatment of the cover section.

The pre-treatment device can be configured to pivot the cover section with respect to the base section, in particular about the kink line that extends between the cover section and the base section, and preferably while the product carrier is conveyed by the conveying device. The product carriers can thus be delivered to the conveying line with a pre-folded cover section.

In accordance with a preferred embodiment of the invention, the pre-treatment device has at least one folding rail for pivoting the cover section. The folding rail can extend along the conveying direction and can have a profile such that the cover section is pivoted about the kink line, in particular about a specific pivot angle while the product carrier is conveyed in the conveying direction. The folding rail can be attached to an outer side of the conveyor line formed by the conveying device, with the cover section disposed on the outer side being able to be conveyed along the folding rail.

The folding rail can have a guide for a cover section that receives the cover section and that has a contour along the conveyor line that effects a pivoting of the cover section, in particular about a specific pivot angle.

The folding rail can run along or can be entrained over a part line of the conveyor line. The folding rail can thereby be made shorter than a rigidly arranged folding rail.

The pre-treatment device can be configured to at least approximately pivot the cover section with respect to the base section about the kink line from a starting location into an end location provided for the cover section or into an intermediate location disposed between the starting location and the end location. The starting location can be that location already mentioned above in which the base section and the cover section are disposed in a common plane and at least substantially form a flat structure.

In addition, a cover section can also have an inner preload so that this preload is activated or becomes active by the pre-treatment device.

In accordance with a preferred embodiment of the invention, the pre-treatment device comprises a robot for pivoting the cover section. The robot can be configured to grip the cover section and to pivot it about the kink line.

Provision can also be made that the robot is configured such that it grips, picks up and/or grasps the product carrier and moves the cover section to a fixed folding device such as a folding shaft. The robot can be configured to carry out a movement relative to the fixed-position folding shaft by means of which a pivoting of the cover section is effected. Alternatively or additionally, the folding device can be movable and can be configured to carry out a movement to effect a pivoting of the cover section with respect to the base section about the kink line. A pivoting of the cover section can be effected in a monitored, controlled manner by the robot and the folding device.

The pre-treatment device can have a compressed air source that is configured and arranged to apply compressed air to the cover section or to suck it in, in particular at least while it is being pre-treated. A pivoting of the cover section can be effected by the application to or by the sucking in of the cover section. The compressed air source can in addition be arranged and configured such that it is movable relative to the cover section such that a pivoting of the cover section is effected by moving the compressed air source. The fixing of the base section by means of a suction device during the pre-treatment is also conceivable.

In accordance with a preferred embodiment of the invention, a gap is formed between an upper active element, in particular a roller or a rail, and a lower active element, in particular a counter-roller, a counter-section or an angled sliding metal plate, and the product carrier can be conveyed through said gap, in particular by means of the conveying device or by means of a robot and/or with a kink line extending in the conveying direction. The product carrier can thus be grasped by the upper and lower active element while it is conveyed through the gap.

The upper and lower active elements can in particular be configured and arranged such that they pivot the cover section of the product carrier with respect to the base section about the kink line during the conveying of the product carrier through the gap. The cover section can thus be pivoted by means of the active elements during the conveying process.

The apparatus in accordance with the invention preferably comprises a kink line generation device and/or a kink line attenuation device that is/are configured to generate at least one kink line in each product carrier and/or to attenuate an existing kink line, in particular by means of ultrasound treatment, moistening, heating and/or by means of a perforation roller to perforate the kink line. A deformation by a cold supply is also conceivable if, for example, the cover section is configured with multiple layers and an inner layer shrinks on a supply of cold such that the cover section is brought into a different location. The kink line can therefore be introduced into the product carrier in the apparatus or an already existing kink line can at least be attenuated, whereby a simpler pivoting of the cover section is possible.

Provision can also be made that the base section and the cover section of a product carrier are first provided separately from one another and that the cover section and the base section are joined together, in particular adhesively bonded together, preferably by means of an adhesive or an adhesive strip.

The pre-treatment device can also be configured such that a pressure joining can be effected with or without a pre-punching of the cover section. At least one cover section is pre-punched in this respect. The cover section is bent up on the closing and folding and is in particular pressed up by means of an associated opening or aperture. A clinching, that is a joggling or pressure joining, can optionally also take place, wherein two layers of product carriers can be punched together and can be connected in a shape-matched manner in so doing. The use of a band is furthermore conceivable that fixes the cover section in the pivoted position, e.g. in the manner of a band used for a packaging or for a present.

The present invention also relates to an apparatus for pivoting a cover section of a product carrier with respect to a base section connected thereto about a kink line extending between the cover section and the base section. The apparatus comprises at least one first conveyor, in particular a conveyor belt, and a second conveyor arranged downstream of the first conveyor, in particular a further conveyor belt whose support surface is arranged, in particular at an adjustable spacing, beneath the support surface of the first conveyor such that the cover section of the product carrier disposed at the rear, viewed in the conveying direction, is pivoted upward with respect to the base section by an end of the first conveyor when the product carrier is conveyed beyond the end of the support surface of the first conveyor onto the support surface of the second conveyor disposed thereunder.

A folding or pivoting of the cover section with respect to the base section can therefore be effected at the transition between the two conveyors. The weight of a product disposed on the base section of the product carrier can in this respect advantageously be utilized for the pivoting or setting upright of the cover section on the falling of the product carrier onto the second conveyor.

A control can be provided that only sets the second conveyor into motion once the product carrier lies, in particular completely, on the support surface of the second conveyor. The second conveyor is thus stationary when the product carrier moves onto the second conveyor. It is thereby ensured that the cover section comes into contact with the mentioned end of the first conveyor and is thus pivoted.

The second conveyor can also be located at the level of the first conveyor to take over the product carrier. It is lowered once the base section lies on the support surface of the second conveyor so that the cover section abuts the mentioned end of the first conveyor facing the second conveyor and is thereby pre-folded or pivoted respectively. The weight of the portion acting on the base section is utilized in this respect.

The control can actuate the second conveyor once the product carrier lies on the support surface of the second conveyor such that the product carrier is conveyed against the conveying direction, wherein the end of the first conveyor serves as an abutment for the cover section to pivot it further, and wherein the control subsequently actuates the second conveyor such that the product carrier is conveyed in the conveying direction.

Provision can be made that the first conveyor is movable in the conveying direction and/or the second conveyor is also movable opposite to the conveying direction. The total first or second conveyors can in particular be moved in a translatory manner, whereby the cover section can be taken along and pivoted.

The invention also relates to an apparatus for pivoting a cover section of a product carrier with respect to a base section connected thereto about a kink line extending between the cover section and the base section, wherein the apparatus comprises a conveyor, in particular a conveyor belt, on whose support surface the product carrier can be conveyed in the conveying direction, and wherein a pivoting device having at least one active element is provided, with the active element being configured and arranged to cooperate with the cover section from above to pivot the cover section of the product carrier disposed on the support surface.

The active element can have a gripping device by means of which the cover section can be gripped and processed or pivoted about the kink line from above, that is coming from above the support surface for the product carrier.

The active element can be integrated into a station through which the conveyor runs. A displacement of the product carrier in the conveying direction can also take place by the active element.

In accordance with a preferred embodiment of the invention, the active element is movable along a part distance of the conveyor over the support surface of the conveyor such that the active element can be moved along in the conveying direction for pivoting the cover section with the product carrier, in particular at least as long as it is in engagement with or acts on the product carrier. In this respect, not only movements in the conveying direction are covered by the movement of the active element, but also relative to the product and to the cover section, in particular with respect to the respective spacing or in the sense of a respective spacing.

The active element can in particular be arranged at a horizontal axis that extends above the support surface of the conveyor and that can preferably be moved along in the conveying direction. Before the next product carrier arrives, the active element can again be moved back into its starting position so that it is ready for cooperation with a new product carrier.

The pivoting device can have a holder that is movable, in particular along the conveying direction, and/or is movable along with the product carrier and by means of which the base section can be fixed and/or held in contact on the support surface. The base section can thus be fixed in its location, in particular during the pivoting of the cover section. The holder can at least be movable over a part of the conveyor line.

The active element can be operated and/or positioned separately or in combination with the holder.

A band machining device can be provided having revolving tools over the length of at least a part of the conveyor line. Each tool can be configured such that it grasps a cover section and pivots it about the kink line. Each tool can be equipped with a downholder for the base section.

The revolving tools can be different machining means and pivoting means or folding means that come into engagement with the cover section in the course of a revolution and are configured, for example, for raising the cover section, for pivoting the cover section, for pressing the pivoted cover section toward the base section and for pressing it further or holding it down. The individual tools can also have different spacings from the support surface of the conveyor in the direction of revolution.

The present invention additionally relates to an apparatus for pivoting a cover section of a product carrier with respect to a base section connected thereto about a kink line extending between the cover section and the base section, wherein the apparatus has at least one conveyor, in particular having a plurality of conveyor bands extending in parallel and in the conveying direction, wherein the product carrier can be conveyed in the conveying direction on the support surface of the conveyor, and wherein a pivoting device is provided having at least one active element that is configured and arranged to cooperate with the cover section from below, in particular through gaps in the support surface of the conveyor or through a gap between two conveyors arranged behind one another, for pivoting the cover section of the product conveyor disposed on the support surface and having the cover section.

The active element can preferably be moved upward and can in particular be pivoted or moved toward the cover section for pivoting the cover section from beneath the support surface. The active element can be brought upward for pivoting the cover section into contact with the product carrier disposed on the support surface. The active element can also be configured for treating the kink line, for example for post-creasing. The active element can preferably be moved down again after the pivoting so that it lies beneath the support surface. A blocking of the conveyor line by the active element can thus be avoided.

A holder is preferably provided for holding and/or fixing the base section on the support surface. The base section can thus be fixed in its location, in particular while the cover section is pivoted.

The holder furthermore preferably cooperates with the base section from the bottom and from the top. The holder can, for example, be lowered onto the base section from above and can press the latter toward the support surface on which the product carrier lies. The holder can subsequently again be moved upward to release the product carrier.

The holder can be configured as a stopper or as an abutment, in particular in the longitudinal direction, that fixes the base section at the end disposed opposite the cover section. Such a holder can be attached to the conveyor and can thus be configured as a co-moving holder.

A suction rail extending transversely to the conveying direction can be provided that grasps the base section from below, in particular in the region of the kink line. A fixing or release of the product carrier can at least be achieved in a simple manner during the folding or treatment process by activation or deactivation of the suction rail.

A holder and/or a suction rail can be present in each of the embodiments shown here. An areal element or a co-running belt having such suction properties can furthermore also be used as a replacement for or as an addition to the suction rail.

The pivoting device can be movable along at least a part distance of the conveyor for pivoting the cover section with the product carrier. The cover section can thus be pivoted during the transport of the product carrier.

The pivoting device can be configured and arranged as a station, in particular in front of or behind the conveyor. The pivoting device can therefore not only be configured in the form of a co-moving device, but also as a local station. A modular design is thereby promoted.

The invention also relates to an apparatus for pivoting a cover section of a product carrier with respect to a base section connected thereto about a kink line extending between the cover section and the base section, wherein the apparatus has at least one conveyor, in particular a conveyor belt, on whose support surface the product carrier can be conveyed in the conveying direction, wherein, for the pivoting of the cover section of a product carrier, at least one folding element is arranged on the support surface of the conveyor and, spaced apart therefrom in the conveying direction, a stop for the production carrier is arranged that cooperates with the folding element, and wherein a feed for delivering a product carrier, in particular having a product disposed on the base section, is provided at the conveyor. And indeed such that the end of the base section of the product carrier remote from the cover section comes into contact with the stop and the cover section is pivoted by the folding element about the kink line, in particular for covering the product.

In this apparatus in accordance with the invention, the folding element and the stop for the product carrier cooperating therewith can thus be arranged on the support surface of the conveyor to effect a folding or pivoting of the cover section, in particular while the product carrier is conveyed in the conveying direction, preferably with a product lying on the product section.

The folding element preferably has a first section that extends at least substantially perpendicular away from the support surface of the conveyor. The folding element comprises a second section that, starting from the end of the first section remote from the support surface, extends inclined to the first section toward the stop, in particular at least substantially in parallel with the support surface. The two sections of the folding element can form a hook-like arrangement that can effect a pivoting of the cover section. The height of the first section, measured from the support surface up to its end remote from the support surface, can in this respect at least approximately correspond to the product height. The height of the first section can be adjustable to enable an adaptation to products of different heights.

A plurality of folding elements are preferably arranged offset to one another, viewed along the conveying direction, with a respective adjacent folding element, in particular the respective folding element that is disposed in front in the conveying direction, forming the stop cooperating with a folding element. A folding element can therefore serve both for folding or pivoting a cover section and as a stop or as a fixing means for a base section.

The spacing between the stop and the folding element can at least approximately correspond to the length of the base section, measured from its end remote from the cover section up to the kink line. The spacing between the stop and the folding element or between adjacent folding elements can be adjustable such that an adaptation to base sections of different lengths is possible.

The feed is preferably arranged upstream of an end of the conveyor at the rear viewed in the conveying direction. The feed and the conveyor thus form a continuous conveyor line for the product carriers and for the products optionally lying thereon.

The invention additionally relates to an apparatus for pivoting a cover section of a product carrier with respect to a base section connected thereto about a kink line extending between the cover section and the base section, wherein the apparatus comprises at least one conveyor, in particular a conveyor belt, on whose support surface the product carrier can be conveyed in the conveying direction. The apparatus additionally comprises a feed for delivering the product carrier, in particular in a direction transversely to the conveying direction, to the conveyor such that the base section comes to lie on the support surface and the cover section moves into an active region of a co-moving folding element arranged at the conveyor or associated therewith. A product feed for delivering a product is provided that is arranged downstream of the feed of the product carrier viewed in the conveying direction of the conveyor, wherein a product can be delivered by means of the product feed such that it comes to lie on the base section, and wherein the folding element is movable from a first position into a second or further position, after or while the product comes to lie on the base section, such that the cover section is pivoted about the kink line by the movement of the folding element. A product can thus be placed on a base section of a product carrier by the apparatus in accordance with the invention and the cover section can be pivoted by means of the folding section to at least partially cover the product.

A plurality of mutually spaced apart folding elements are preferably arranged at the conveyor along the conveying direction. A sequence of product carriers disposed behind one another can thereby be conveyed whose respective cover section can be pivoted and on whose base section a product can be brought to lie. A kind of cycle chain can so-to-say thus be implemented, namely a chain of product carriers conveyed on the conveyor and having products disposed thereon and partially pre-treated and partially covered by the cover sections.

The spacing of the folding elements can be adjustable. The folding elements can be movably supported. To adjust the folding elements from the first position into the second or further position, the folding elements can be pivotable about a pivot axis extending perpendicular to the conveying direction and disposed in the plane of the support surface. Each folding element can additionally be preloaded against the second position in the first position such that the folding element is moved into the second position when it is released in the first position. A restoring mechanism can restore the respective folding element back into its first position from the second position.

The invention also relates to an apparatus for pivoting a cover section of a product carrier with respect to a base section connected thereto about a kink line extending between the cover section and the base section, wherein the apparatus has at least one conveyor, in particular a conveyor belt, on whose support surface the product carrier can be conveyed along the conveying direction with the cover section disposed at the front viewed in the conveying direction. The apparatus additionally comprises a pivoting device for pivoting the cover section disposed at the front, viewed in the conveying direction, about the kink line, wherein the pivoting device is integrated in the conveyor or is arranged downstream thereof. Furthermore a rotational device is provided for rotating the product carrier about 180°, and indeed such that the cover section is disposed at the rear, viewed in the conveying direction, after the rotating procedure.

The cover section can thus be delivered to the pivoting device with its cover section at the front and can be pivoted there. The product carrier can subsequently be rotated so that its cover section is at the rear viewed in the conveying direction. This is advantageous for the delivery of the product carrier having the product disposed thereon to a packaging machine arranged downstream.

The rotational device can be arranged upstream or downstream of the conveyor and of the pivoting device. A respective rotational device can also be provided both before and after the conveyor and the pivot device viewed in the conveying direction. An incoming product carrier can be rotated such that it is delivered to or conveyed through the pivoting device with the cover section disposed at the front and it can subsequently be rotated by 180° again such that it can be delivered to the packaging machine with the cover section remote from the packaging machine.

The present invention also relates to an apparatus for pivoting a cover section of a product carrier with respect to a base section connected thereto about a kink line extending between the cover section and the base section, wherein the apparatus has at least one conveyor, in particular a conveyor belt, on whose support surface the product carrier can be conveyed along the conveying device, with the at least one kink line being arranged in parallel with the conveying direction. In addition, a pivoting device is provided for pivoting the cover section about the kink line, wherein the pivoting device pivots the cover section, in particular when passing through an associated part distance, while said cover section is conveyed on the conveyor. The apparatus further comprises a second conveyor that is arranged downstream of the conveyor and whose conveying direction extends perpendicular to the conveying direction of the first conveyor. Provision is made that the product carrier is conveyed on the first conveyor belt such that the kink line is aligned at least substantially along the conveying direction and is preferably disposed at the rear viewed in the conveying direction of the second conveyor.

A further, third conveyor is preferably arranged upstream of the first conveyor and its conveying direction extends at least substantially perpendicular to the conveying direction of the first conveyor. The product carriers together with a product can be delivered to the first conveyor by means of the third conveyor or a flow of products can be delivered, wherein a respective product can be placed on the base section of a respective product carrier delivered by means of the first conveyor or of a further conveyor.

The invention additionally relates to an apparatus for pivoting a cover section of a product carrier with respect to a base section connected thereto about a kink line extending between the cover section and the base section, wherein the apparatus has at least two consecutive conveyors for conveying the product carrier along a conveying direction, wherein the product carrier can be conveyed such that the base section of the product carrier is disposed on one of the conveyors and the cover section is located at least partially above the other conveyor, and wherein, to pivot the cover section, at least the end of the respective conveyor facing the other conveyor carrying the base section is lowerable.

With this apparatus, a pivoting or folding of the cover section thus takes place by lowering the one conveyor with respect to the other conveyor, which is comparatively simple to implement.

The lowerable conveyor is preferably arranged downstream of the other conveyor, wherein provision is in particular made that the product carrier is conveyed with a cover section disposed at the rear viewed in the conveying direction. When the base section lies on the lowerable conveyor, at least a part of the cover section is still above the other conveyor that is arranged upstream and that serves as an abutment for the cover section when the lowerable conveyor is lowered. A pivoting of the cover section about the pivot line takes place during the lowering of the lowerable conveyor due to the abutment at the other conveyor. In this respect, the weight of the portion lying on the base section is also a help.

A gap is preferably provided between the conveyors and its extent is smaller, viewed in the conveying direction, than the length of the cover section, measured from the kink line up to the edge of the cover section disposed remotely from the kink line.

The gap is preferably bridged by means of a metal sheet or by means of webs, wherein the metal sheet or the webs is/are arranged at the lowerable end of the one conveyor. The metal sheet or the webs can thus form a support surface for the product carriers in the region of the gap.

A folding means can be provided that is configured to move through a gap created between the conveyors due to the lowering with a lowered conveyor and to pivot the cover section.

After the lowering of the one conveyor, at least one of the conveyors can be movable in the direction of the other conveyor, in particular for carrying out or continuing the folding procedure along the kink line.

The invention additionally relates to an apparatus for pivoting a cover section of a product carrier with respect to a base section connected thereto about a kink line extending between the cover section and the base section, wherein the apparatus comprises a first conveyor and a second conveyor arranged above the first conveyor, wherein the two conveyors form a gap through which a product carrier can be conveyed, and wherein a feed is provided to deliver the product carrier with the cover section at the front into the gap, with the product carrier being delivered to the gap with an already pre-folded cover section.

The product carrier can be delivered to the gap with the pre-folded section, whereby the two conveyors forming the gap can further fold the cover section on the introduction of the cover section into the gap.

The invention furthermore relates to an apparatus for pivoting a cover section of a product carrier with respect to a base section connected thereto about a kink line extending between the cover section and the base section, wherein the apparatus comprises at least one conveyor, in particular a conveyor belt, on whose support surface the product carrier can be conveyed along the conveying direction with the cover section disposed at the front or at the rear, viewed in the conveying direction, and wherein the apparatus additionally comprises a pivoting device having at least one active element that is configured to grasp the cover section at at least one of its two lateral margins, and wherein the active element is movable at least from a first position into a second position for pivoting the cover section about the kink line.

The active element can grasp the section from the side, that is at one of its two lateral margins disposed outwardly transversely to the conveying direction, and can pivot or fold it by a movement from the first position into the second position.

The active element can be movable in the transverse direction with respect to the conveying direction, in particular for grasping and releasing the cover section. The active element can be brought into engagement or into operative connection with the cover section by a movement transversely to the conveying direction. For example, the cover section can be released again by a movement in the opposite direction.

The active element is preferably movable along the conveyor line such that the active element can be moved along with the product carrier while the latter is conveyed along the conveyor line. The cover section can therefore be folded while the product carrier is moved along the conveyor line.

The active element is preferably arranged at a separate conveyor that revolves in parallel with the conveyor for the product carrier. The active element can be moved along with the product carrier by means of the separate conveyor. A plurality of active elements arranged offset are preferably present along the conveyor.

The revolution speed of the separate conveyor is preferably adjustable, in particular relative to the revolution speed of the conveyor for the product carrier. The folding or pivoting procedure of the cover section can be assisted by a relative movement between the active element and the product carrier.

The separate conveyor preferably revolves about at least one axis that extends at least approximately perpendicular to or in parallel with the support surface for the product carriers. An interaction between the active elements arranged at the conveyor and the cover sections of the product carriers can thereby be achieved in a simple manner.

The active element can be rotatable about an axis of rotation that is disposed laterally next to the support surface and that is in particular adjustable, with the axis of rotation extending at least substantially perpendicular to the support surface or being slightly inclined with respect to the perpendicular. The active element can be brought into contact or out of contact with the respective cover section by a rotation about the axis of rotation while the product carriers are transported along the conveyor line.

The active element is preferably arranged at a rotary disk or eccentric disk rotatably arranged about the axis of rotation, with, preferably, a plurality of active elements being arranged offset from one another at least over a section of the outer periphery of the rotary disk or eccentric disk and being able to be brought into engagement by the rotation about the axis of rotation.

The active elements can in particular be configured in the form of bars, as lugs or as brushes. The active elements can consist of plastic and are preferably configured as at least slightly elastic.

The invention further relates to an apparatus for pivoting a cover section of a product carrier with respect to a base section connected thereto about a kink line extending between the cover section and the base section, wherein the apparatus comprises at least one conveyor, in particular a conveyor belt, having a support surface for the product carrier, wherein the conveyor is rotatable in a rotational direction about a horizontal axis of rotation disposed outside the conveyor, in particular such that the alignment of the conveyor at least does not substantially change, wherein the product carrier can be delivered in a first rotational position of the conveyor of the product carriers such that the base section comes to lie on the support surface, wherein, in a further, second rotational position of the conveyor that is arranged downstream of the first rotational position viewed in the rotational direction, a product can be applied to the base section, and wherein a pivoting device for pivoting the cover section about the kink line is arranged downstream of the second rotational position, viewed in the rotational direction.

The apparatus can be configured in the manner of a circle that rotates in the rotational direction and that enables the delivery of a product carrier, the application of a product to the base section of the product carrier, and a pivoting of the cover section about the kink line relative to the base section for the at least partial covering of the product in dependence on the rotational position of the conveyor. A plurality of conveyors, preferably four conveyors, can also move about a common center.

The rotational movement can be utilized for carrying out the pivoting or the folding procedure for the cover section. The product carrier in this respect preferably rotates past the pivot device and thus achieves the desired effect of a pivoting or of a folding of the cover section about the kink line.

In yet a further, third rotational position of the conveyor that serves for the transfer, a conveying device can be arranged downstream of the conveyor. The product carrier and the product lying thereon with the pivoted cover section can be transported onward by means of the conveying device, in particular in the direction of a packaging station.

The apparatus preferably has at least three such conveyors that are arranged offset from one another viewed in the rotational direction.

The invention additionally relates to an apparatus for pivoting a cover section of a product carrier with respect to a base section about a kink line extending between the cover section and the base section, wherein the apparatus comprises at least one auger conveyor for conveying the product carrier along a conveying direction. The product carrier can be guided along the conveying direction by means of the auger conveyor.

Two auger conveyors that are in particular synchronously operable are preferably provided for conveying the product carrier to the two outwardly disposed side margins viewed perpendicular to the conveying direction. The product carrier can thus be conveyed between the two auger conveyors. The auger conveyor or auger conveyors can be configured and/or arranged such that the spacing between the product carriers is narrowed and in addition a respective product carrier is fixed by the auger conveyor or auger conveyors. This procedure can already contribute to an at least partial pivoting of the cover section. Additionally or alternatively a pivoting device can also be provided.

A pivoting device is preferably provided that has an active element that is configured and arranged to grasp the cover section and to pivot it about the kink line, in particular while the base section is fixed by means of the auger conveyor and/or is conveyed along the conveying direction.

The pivoting device preferably grips the cover section coming from the rear.

The invention additionally relates to an apparatus for pivoting a cover section of a product carrier with respect to a base section connected thereto about a kink line extending between the cover section and the base section, wherein the apparatus has at least one conveyor, in particular a conveyor belt, having a support surface for the product carrier. The apparatus additionally comprises an element arranged downstream of the conveyor in the conveying direction and having a support surface for the product carrier, wherein the support surface of the element has a length, viewed along the conveying direction, that substantially corresponds to the length of the base section, measured form the kink line up to the edge of the base section disposed remotely from the kink line. The support surface of the element is in this respect downwardly movable, can in particular be lowered, folded down or moved away fast, with respect to the support surface of the conveyor.

By the downward movement of the support surface of the element, the base section with a product disposed thereon can be lowered with respect to the support surface of the conveyor, whereas the support surface of the conveyor serves as an abutment for the cover section. A pivoting of the cover section during the downward movement of the support surface of the element can thus be carried out.

Provision is preferably made that the product carrier with a cover section disposed at the rear viewed in the conveying direction and in particular having a product disposed on the base section is conveyed onto the support surface of the element such that at least a part of the cover section is located above the conveyor and that the support surface of the elements is then moved downwardly such that the cover section abuts the conveyor and is pivoted about the kink line.

By the downward movement of the support surface of the element, a falling of the product carrier through the opening resulting in the support surface of the conveyor is made possible and a pivoting of the cover section is effected. It is advantageous in this respect if the product lies on the base section of the product carrier since normally no additional downholder is required for the base section due to the weight of the product. In addition, a folding apparatus can be provided that pivots the already pivoted cover section further, in particular with a lowered support surface of the element, such that the cover section reaches its intended end position and at least partially covers the product. A pivoting back of a part of the support surface from the lower opening position can be utilized for this purpose. On the upward closing movement, the cover section is then grasped from the outside and is further pivoted.

Figure 2:
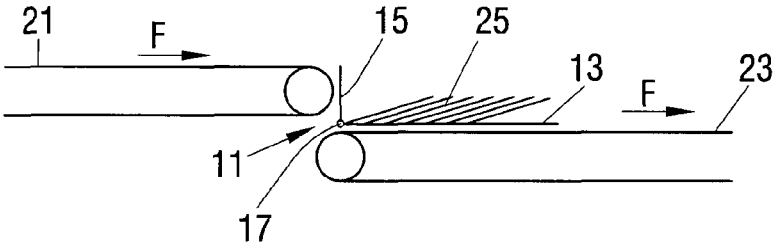
Figure 3:
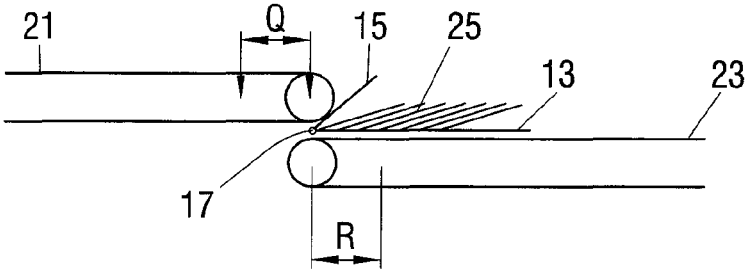
Figure 4:
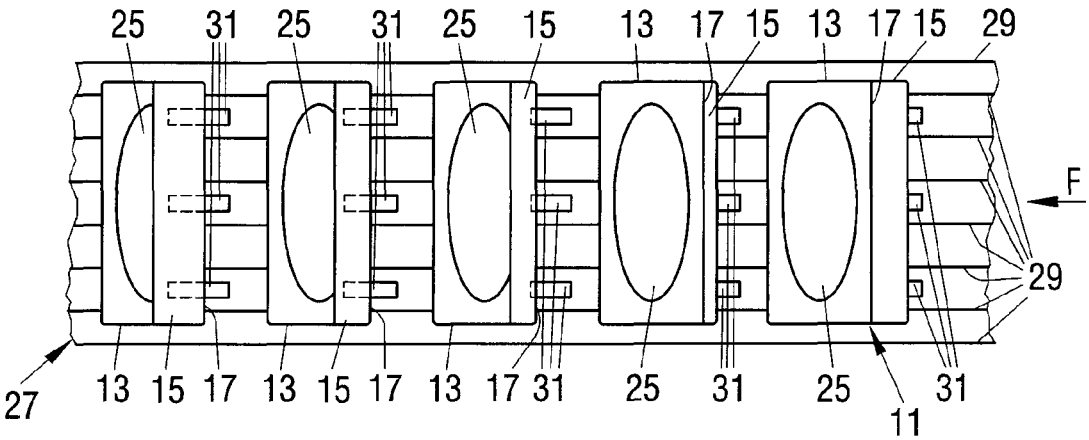
Figure 5:
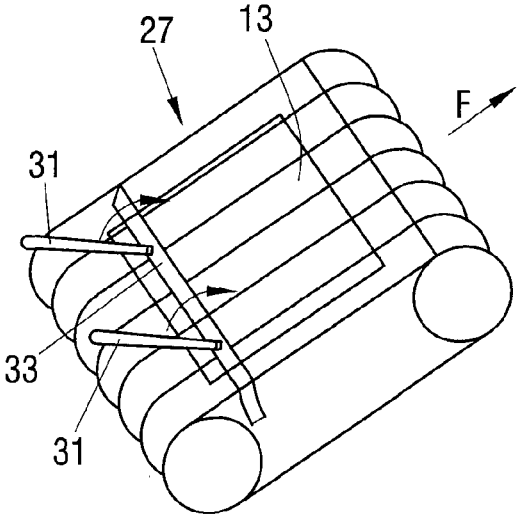
Figure 23:
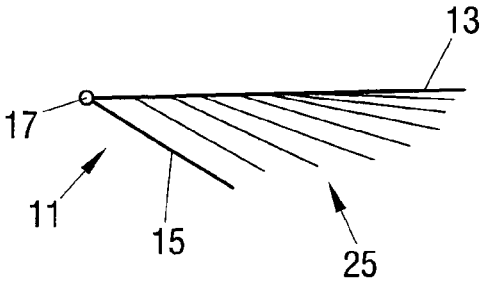
Figure 6:
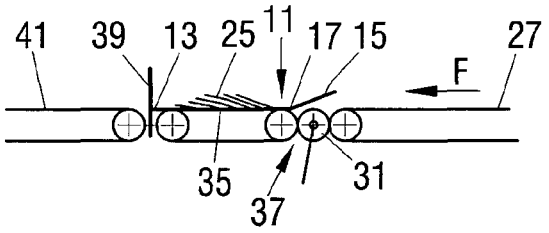
Figure 7:
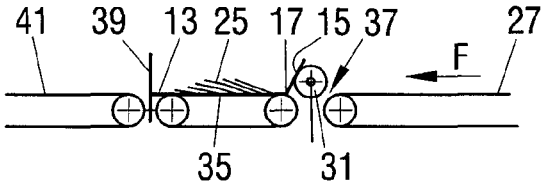
Figure 8:
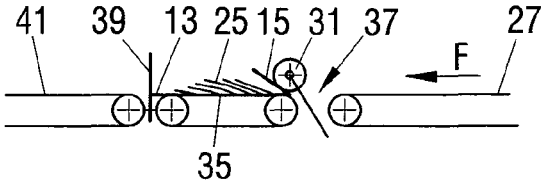
Figure 9:
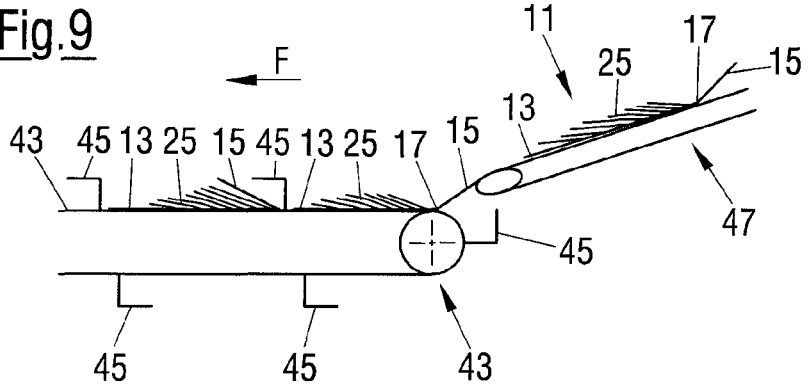
Figure 13:
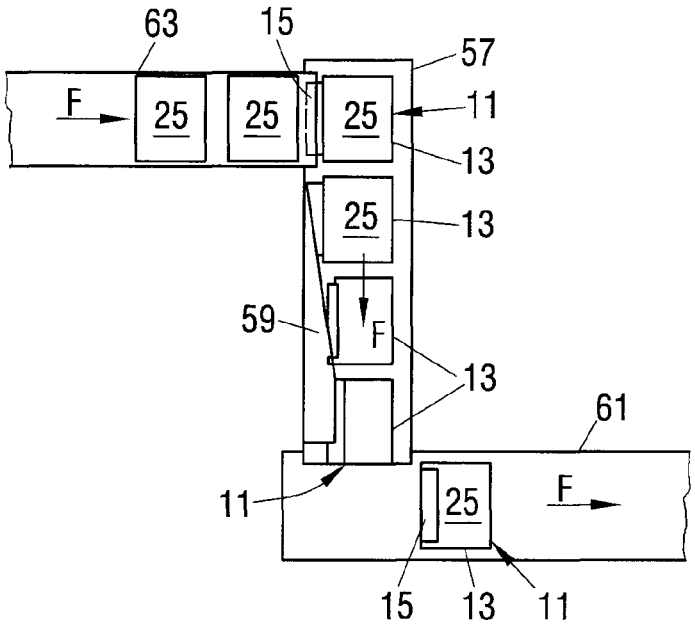
Figure 14:
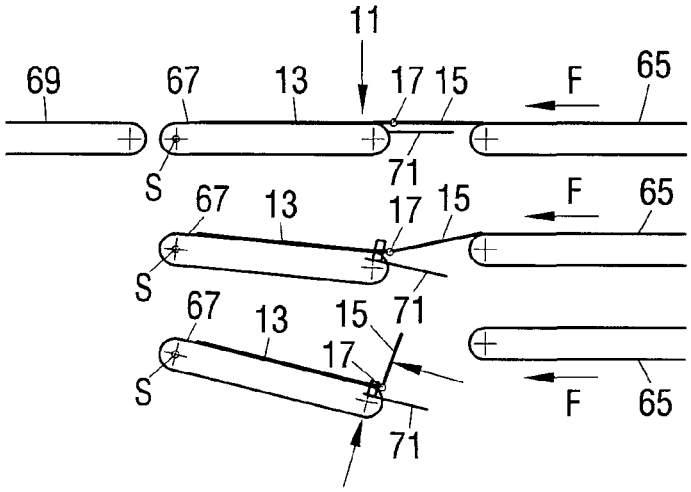
Figure 15:
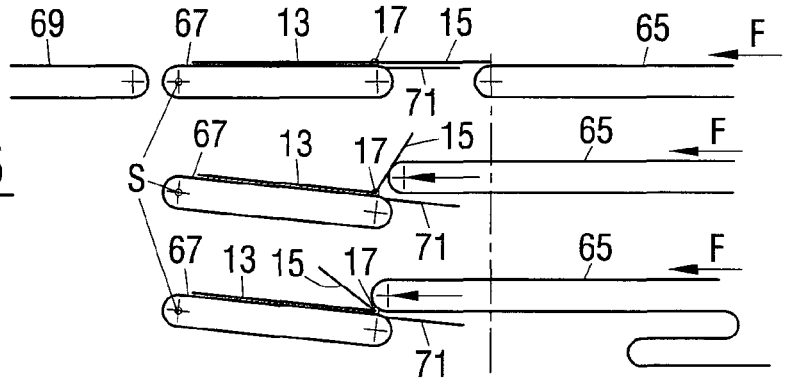
Figure 16:
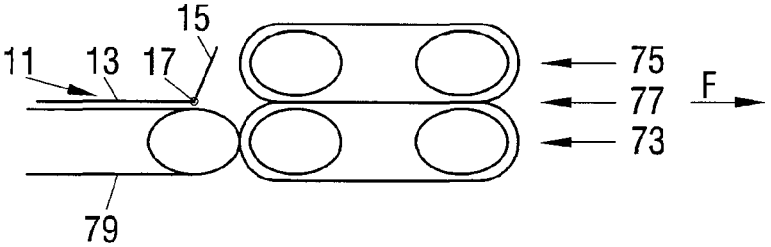
Figure 17:
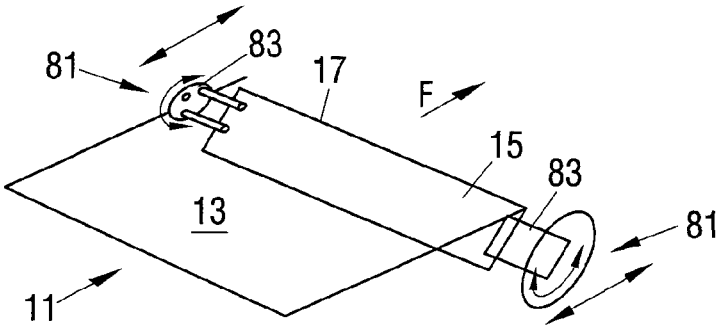
Figure 18:
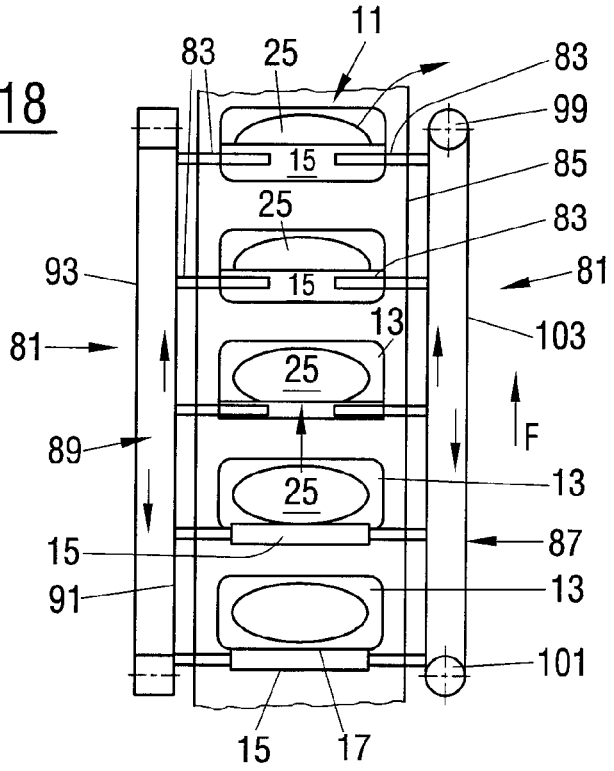
Figure 19:
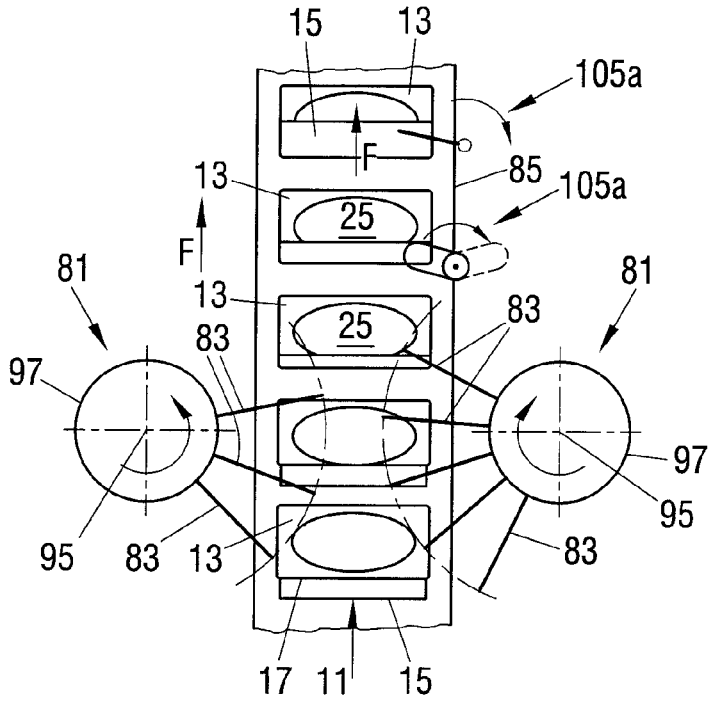
Figure 20:
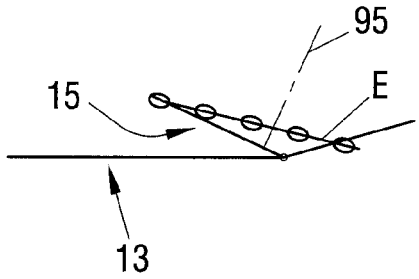
Figure 21:
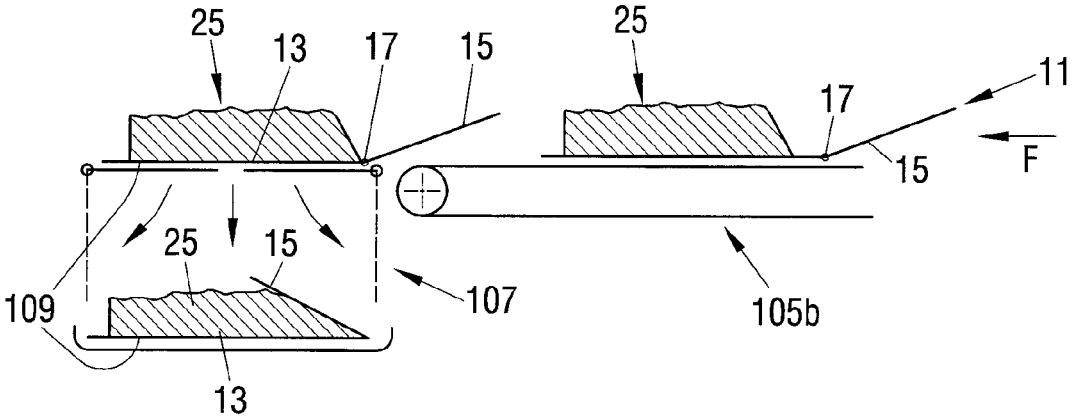
Figure 22:
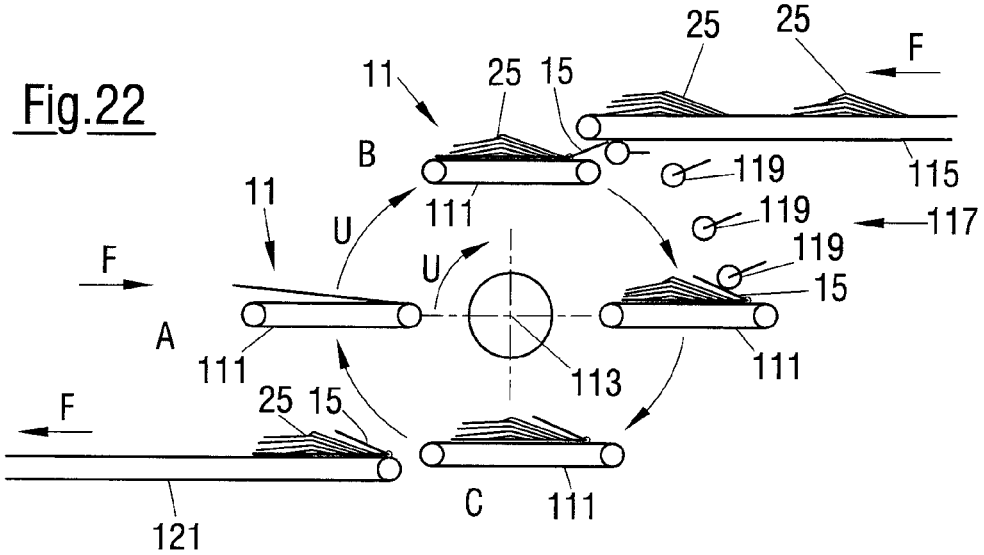

The invention will be explained by way of example in the following with reference to preferred embodiments. There are shown, schematically in each case, FIG. 1 a lateral view of a product carrier;

FIGS. 2 and 3 a lateral view of a variant of an apparatus for pivoting a cover section of a product carrier;

FIG. 4 a plan view of a further variant of an apparatus for pivoting a cover section of a product carrier;

FIG. 5 a perspective view of a further variant of an apparatus for pivoting a cover section of a product carrier having a suction rail for fixing a product carrier;

FIGS. 6 to 8 lateral views of a further variant of an apparatus for pivoting a cover section of a product carrier;

FIG. 9 a lateral view of a further variant of an apparatus for pivoting a cover section of a product carrier;

FIG. 10 a plan view of a further variant of an apparatus for pivoting a cover section of a product carrier;

FIG. 11 a lateral view of the variant of FIG. 10;

FIG. 12 a plan view of a further variant of an apparatus for pivoting a cover section of a product carrier;

FIG. 13 a plan view of a further variant of an apparatus for pivoting a cover section of a product carrier;

FIG. 14 a lateral view of a further variant of an apparatus for pivoting a cover section of a product carrier;

FIG. 15 a lateral view of a further variant of an apparatus for pivoting a cover section of a product carrier;

FIG. 16 a lateral view of a further variant of an apparatus for pivoting a cover section of a product carrier;

FIG. 17 a perspective view of a further variant of an apparatus for pivoting a cover section of a product carrier;

FIG. 18 a plan view of a further variant of an apparatus for pivoting a cover section of a product carrier;

FIG. 19 a plan view of a further variant of an apparatus for pivoting a cover section of a product carrier;

FIG. 20 a lateral view of a product carrier for illustrating the extent of a preferred direction of an axis of rotation in the variant of FIG. 19;

FIG. 21 a lateral view of a further variant of an apparatus for pivoting a cover section of a product carrier;

FIG. 22 a lateral view of a further variant of an apparatus for pivoting a cover section of a product carrier; and FIG. 23 a lateral view of a product carrier and of a product that are upside down.

The product carrier 11 shown in FIG. 1 comprises a base section 13 onto which a product is placed and a cover section 15 connected to the base section 13. In this respect, a kink line (also known as a folding line) 17 is provided between the cover section 15 and the base section 13, about which the cover section can be pivoted or folded, and indeed in the arrow direction P drawn in FIG. 1, such that the originally upwardly facing side of the cover section 15 is disposed opposite the upwardly facing side of the base section 13 and a product lying on the base section 13 is in particular at least partially covered.

As is furthermore shown in FIG. 1, an apparatus for the delivery of product carriers 11 to a conveying line for food products or an apparatus for pivoting the cover section 15 of the product carrier 11 with respect to the base section 13 can have a folding rail 19 that is lowerable from above onto the product carrier 11 such that the folding rail 19 fixes the product carrier 11 along the kink line 17.

A perforation or the like can be provided beneath the product carrier 11 in the support surface that extends along the kink line 17. The pivoting procedure can thereby be improved in combination with the folding rail 19.

The cover section 15 can be pivoted in the direction of the arrow P by a pivoting device, in particular for covering a product disposed on the base section 13, while fixing the product carrier 11. The pivoting device can have a sliding metal sheet or a guide rail that serves as a base for the product carrier 11 and sets the cover section 15 at least a little upright while the product carrier 11 is conveyed over it.

FIGS. 2 and 3 show an apparatus for pivoting a cover section 15 of a product carrier 11 with respect to a base section 13 connected thereto about a kink line 17 extending between the cover section 15 and the base section 13. The apparatus has a first conveyor 21 that—as is shown in FIG. 2—is configured in the manner of a conveyor belt and has a second conveyor 23 that is arranged downstream of the first conveyor 21 and is likewise configured as a conveyor belt. The support surface provided by the second conveyor 23 for the product carrier 11 is arranged at an adjustable spacing beneath the support surface of the first conveyor 21.

The product carrier 11 is delivered by the first conveyor 21 along a conveying direction F, and indeed such that the cover section 15 is disposed at the rear viewed in the conveying direction F. When the product carrier 11 is conveyed by the support surface of the first conveyor 21 beyond the end of the conveyor 21 at the front, viewed in the conveying direction F, onto the support surface of the second conveyor 23 disposed thereunder, the cover section 15 is pivoted upwardly by the mentioned end of the first conveyor 21 with respect to the base section 13. In this respect, the weight of the product 25 disposed on the base section 13 assists the pivoting procedure. The pivoting procedure is furthermore assisted in that the second conveyor 23 is only taken into operation after the base section 13 has come to lie on its support surface and the pivoting of the cover section 15 has thus taken place, as shown in FIG. 2.

The cover section 15 is pivoted upwardly by approximately 90° from a position in which it lies on the support surface. To pivot the cover section 15 even further in the direction of the product 25, it can be advantageous if the second conveyor 23 is first operated opposite to the conveying direction F, whereby the mentioned end of the first conveyor 21 serves as an abutment for the cover section 15 and pivots it further, as is shown in FIG. 3 by way of example.

It can be advantageous if the upper, first conveyor 21 can be moved as a whole in a translatory manner in the direction of the lower, second conveyor 23 (cf. the arrow Q in FIG. 3) and/or if the second conveyor can be moved in the direction of the first conveyor 21 (cf. the arrow in FIG. 3). A further pivoting of the cover section 15 with respect to the base section 13 can thereby likewise be effected.

The vertical spacing between the support surface of the first conveyor 21 and of the second conveyor 23 can be adjustable, whereby an adaptation to differently dimensioned product carriers or differently long cover sections 15 of the product carriers 11 is possible.

Provision can be made in a modification of the variant shown in FIGS. 2 and 3 that the support surface of the second conveyor 23 is first located at the same level as the support surface of the first conveyor 21 such that the base section 13 can be moved directly from the first conveyor 21 onto the support surface of the second conveyor 23. Subsequently, the second conveyor 23 can be lowered, whereby, as has been described above, the cover section 15 is pivoted by the end of the first conveyor 21 disposed at the front viewed in the conveying direction F.

FIG. 4 shows an apparatus for pivoting a cover section 15 of a product carrier 11 with respect to a base section 13 connected thereto about a kink line 17 extending between the cover section 15 and the base section 13. The apparatus comprises at least one conveyor 27 having a plurality of parallel conveyor bands 29 that extend in the conveying direction F and that form a support surface on which the product carrier 11 can be conveyed along the conveying direction F. A pivoting device is furthermore provided having active elements 31 that are configured and arranged, for the pivoting of the cover section 15 of the product carrier 11, to cooperate with the cover section 15 from below, in particular through gaps between the conveyor bands 29, to pivot said cover section about the kink line 17.

As FIG. 4 shows, a respective three active elements 31 can, for example, be arranged in a row extending transversely to the conveying direction F and can pivot the cover section 15 from below. Every active element 31 can in this respect be configured as a kind of lever that is moved upwardly through the support surface and in this respect carries out a pivot movement that takes along the cover section 15 and pivots it about the kink line 17. The active elements 31, for example three active elements, arranged in a row extending transversely to the conveying direction F can be moved along with the product carrier 11 over a part distance along the conveying direction F such that—as is indicated in FIG. 4—the pivoting procedure is carried out while the product carrier 11 is conveyed along the conveying direction F. At the end of the conveyor line (cf. the left side of FIG. 4), the active elements 31 release the cover section 15 and the product carrier 11 is conveyed with the product 25 lying thereon further in the conveying direction F. The active elements 31 again dip downwardly or they are moved downwardly beneath the support surface and are moved back opposite to the conveying direction F to the start of the conveyor line to carry out the same treatment step at subsequent product carriers 11.

The product carrier 11 can be held by the product 25 disposed on the base section 13. In addition, however, a holder (not shown in FIG. 4) can also be provided for holding and/or fixing the base section 13 on the support surface of the conveyor 27. The holder is lowered onto the base section 13 from above such that the holder cooperates with the base section 13 from above.

Provision can alternatively be made that the holder cooperates with the base section 13 coming from beneath the support surface. FIG. 5, for example, shows a suction line 33 that extends over the width of the conveyor 27 and that can suck and fix the base section 13 from beneath the support surface of the conveyor 27, in particular in the region of the kink line 17 (not shown in FIG. 5).

FIGS. 6 and 8 show an apparatus for pivoting a cover section 15 of a product carrier 11 with respect to a base section 13 connected thereto about a kink line 17 extending between the cover section 15 and the base section 13. The apparatus comprises a first conveyor 27 on whose support surface the product carrier 11 is conveyed in the conveying direction F and can be delivered to a second conveyor 35 arranged downstream. In this respect a gap 37 is provided between the two conveyors 27, 35 in which gap an active element 31 of a pivoting device is arranged.

An abutment 39 that is movable up and down is arranged downstream of the second conveyor 35 viewed in the conveying direction F. The abutment 39 is provided to fix or hold down the base section 13 at its end disposed opposite the cover section 15.

The second conveyor 35 is dimensioned such that, when the base section 13 of the product carrier 11 abuts the abutment 39, the cover section 15 is located above the active element 31. The active element 31 can be pivoted upward and to the side through the gap 37, whereby a pivoting of the cover section 15 about the kink line 17 is achieved such that the cover section 15 at least partially covers the product disposed on the base section 13.

Once the folding procedure for the cover section 15 has been concluded, the abutment 39 can be moved away to the bottom such that the product carrier 11 can be transported further in the conveying direction F together with the product 25 disposed on the base section 13, in particular by means of a third conveyor 41 arranged downstream of the second conveyor 35.

FIG. 9 shows an apparatus for pivoting a cover section 15 of a product carrier 11 with respect to a base section 13 connected thereto about a kink line 17 extending between the cover section 15 and the base section 13. The apparatus comprises a conveyor 43 that is configured as a conveyor belt and on whose support surface a respective product carrier 11 can be conveyed in the conveying direction F. To pivot the cover section 15 of a product carrier 11, a plurality of folding elements 45 spaced apart, viewed in the conveying direction are arranged on the support surface of the conveyor 43.

In addition, a feed 47 for delivering the product carriers 11 is provided that is formed by a conveyor arranged upstream viewed in the conveying direction F. As can furthermore be seen from FIG. 9, a product carrier 11 is delivered by the feed 47 such that the end of the base section 13 of the product carrier 11 remote from the cover section 15 comes into contact with the rear side of a folding element 45 and/or is fixed thereat and such that the cover section 15 is grasped and pivoted about the kink line 17 by a folding element 45 that is arranged downstream and that has just moved upwardly into the plane of the support surface at the rear end of the conveyor 43 viewed in the conveying direction F. It is particularly advantageous for this purpose if—as FIG. 9 shows—each folding element 45 is configured in the manner of a hook and thus has a first section that extends upwardly perpendicularly away from the support surface of the conveyor 43 and has a second section that extends to the front, starting from the end of the first section remote from the support surface, viewed in the conveying direction F.

As has been explained above, a respective folding element 45 serves as an abutment for a product carrier 11 delivered via the feed 47 such that, in the variant shown in FIG. 9, a folding element 45 thus also forms a respective stop for a product carrier 11 whose cover section 15 is folded by a folding element 45 arranged downstream of a folding element 45 forming the stop. The spacing between adjacent folding elements 45 thus advantageously approximately corresponds to the length of a base section 13, measured from its end remote from the cover section 15 up to the kink line 17.

The folding elements 45 can be arranged, viewed along the conveying direction F, adjustably at the conveyor 43, whereby an adaptation to differently long base sections 13 is possible. Folding elements 45 can also be removed from the conveyor 43 so that the folding elements 45 are advantageously releasably attached to the conveyor 43.

FIGS. 10 and 11 show an apparatus for pivoting a cover section 15 of a product carrier 11 with respect to a base section 13 connected thereto about a kink line 17 extending between the cover section 15 and the base section 13. The apparatus comprises a conveyor 49 that is preferably configured as a revolving conveyor belt and on whose support surface the product carrier 11 can be conveyed in the conveying direction F. In addition, a feed 51 is provided for the product carriers 11 that provides or delivers the product carriers 11 one by one in a direction transversely to the conveying direction F to the conveyor 49, and indeed such that the base section 13 of each product carrier 11 comes to lie on the support surface of the conveyor 49 and such that the cover section 15 moves into an angular range of a folding element 53 arranged at or associated with the conveyor 49 and co-rotating.

A product feed 55 is provided above the conveyor 49 for delivering products 25 and is arranged, viewed in the conveying direction F of the conveyor 49, downstream of the feed for the product carriers 11. A respective product 25 can be delivered by means of the product feed 55 such that it comes to lie on the base section 13 of a product carrier 11 disposed on the conveyor 49.

Provision is made in the apparatus that the folding element 53 is pivoted from a first position into a second position after or while the product 25 comes to lie on the base section 13 such that the cover section 15 is pivoted about the kink line 17 by the movement of the folding element 53. As is indicated in FIG. 11, a respective folding element 53 can in this respect be pivoted about a pivot axis extending transversely to the conveying direction F.

FIG. 11 furthermore shows that a plurality of spaced apart folding elements 53 are arranged at the conveyor 49 along the conveying direction F. A cycle chain is thereby so-to-say implemented by the conveyor 49 along which a plurality of product carriers 11 together with the products 25 disposed thereon can be conveyed and whose respective cover section 15 can be pivoted by one of the folding element 53 for the at least partial covering of the products 25.

FIG. 12 shows an apparatus for pivoting a cover section 15 of a product carrier 11 with respect to a base section 13 connected thereto about a kink line 17 extending between the cover section 15 and the base section 13. The apparatus comprises a first conveyor 57, configured for example as a revolving conveyor belt 57, on whose support surface the product carrier 11 can be conveyed along the conveying direction F, and indeed such that the kink line 17 of the product carrier 11 extends in parallel with the conveying direction F.

A pivoting device 59 that is formed by a folding rail, for example, is arranged over a part distance of the conveyor 57. The pivoting device 59 is located, as FIG. 12 shows, on that side of the conveyor 57 which is outwardly disposed transversely to the conveying direction F and on which the cover section 15 also lies. The pivoting device 59 is configured to pivot the cover section 15 about the kink line 17 while said cover section is conveyed on the conveyor 57 and passes through the part distance along which the pivoting device 59 is provided.

A further, second conveyor 61 whose conveying direction F extends perpendicular to the conveying direction of the first conveyor 57 is arranged downstream of the first conveyor 57. In this respect, the second conveyor 61 furthermore extends relative to the first conveyor such that the kink line 17 is disposed at the rear viewed in the conveying direction F of the second conveyor 61. This has the advantage that the kink line 17 or the cover section 15 are remote from a packaging machine when the product carrier 11 together with the product 25 disposed on the base section 13 is delivered to a packaging machine (not shown).

As FIG. 12 shows, a further, third conveyor 63 by means of which the product carriers 11 are delivered together with the product 25 disposed thereon can be arranged upstream of the first conveyor 57.

FIG. 13 shows a modification of the apparatus of FIG. 12. In the apparatus of FIG. 13, the product carriers 11 are delivered via the first conveyor 57 while the products 25 are delivered only via the third conveyor 63. In this respect, a respective product 25 is placed on a base section 13 of a product carrier 11.

Alternatively to a feed of the product 11 via the conveyor belt, an additional further conveyor belt can also be provided that delivers the product carriers 11 (not shown), for example also at the point at which the products 25 are delivered to the conveyor 57. The delivery of the product carriers 11 and of the products 25 can be synchronized in this respect such that a respective product 25 is placed on the base section 13 of a respective product carrier 11.

FIG. 14 shows an apparatus for pivoting a cover section 15 of a product carrier 11 with respect to a base section 13 of the product carrier 11 about a kink line 17 extending between the cover section 17 and the base section 13 and illustrates the pivoting procedure. The apparatus comprises a first conveyor 65 and a second conveyor 67 which is arranged downstream of the first conveyor 65, viewed in the conveying direction F and a further, third conveyor 69 is arranged downstream thereof.

Provision is made with the apparatus of FIG. 14 that the product carrier 11 is conveyed with a cover section 15 disposed at the rear viewed in the conveying direction F. Provision is furthermore made that the product carrier 11 is conveyed onto the second conveyor 67 such that the base section 13 lies completely on the support surface provided by the second conveyor 67 while the cover section 15 still lies at least partially above the first conveyor 65.

In the apparatus of FIG. 14, the end of the second conveyor 67 facing the first conveyor 65 is lowerable. This is achieved in that the first conveyor 65 can be pivoted about a pivot axis S that extends through the end of the first conveyor 65 facing the third conveyor 69. On the lowering of the end of the second conveyor 67 facing the first conveyor 65, the cover section 15 abuts the first conveyor 65, whereby it is pivoted upwardly, as is shown in FIG. 14.

A gap can be provided between the two conveyors 65 and 67 whose extent, viewed in the conveying direction F, is smaller than the length of the cover section 15, measured from the kink line 17 up to the edge of the cover section 15 remote from the kink line 17. The gap can be bridged by means of a metal sheet 71 or by webs extending in parallel with one another along the conveying direction F, with the metal sheet 71 or the webs being arranged at the lowerable end of the second conveyor 67.

FIG. 15 shows a modification of the apparatus of FIG. 14. In the apparatus of FIG. 15, the first conveyor 65 can be moved, after the lowering of the second conveyor 67, in the conveying direction F or in the direction of the second conveyor 67, whereby a further pivoting of the cover section 15 can be effected.

FIG. 16 shows an apparatus for pivoting a cover section 15 of a product carrier 11 with respect to a base section 13 connected thereto about a kink line 17 extending between the cover section 15 and the base section 13. The apparatus comprises a first conveyor 73 and a second conveyor 75 arranged above the first conveyor 73, wherein the two conveyors 73, 75 form a gap 77 through which the product carrier 11 can be conveyed. A feed 79 in the form of a further conveyor arranged upstream in the conveying direction for delivering the product carrier 11 with the cover section 15, that has in particular already been pre-folded, at the front into the gap 77 such that the cover section 15 is further folded by the two conveyors 73, 75 on entry into the gap 77 and is brought into contact with the base section 13. At the end of the gap 77 remote from the feed 79, the product carrier 11 can leave the gap 77 and can, for example, be delivered to a further conveyor arranged downstream in the conveying direction F.

FIGS. 17 to 19 show different variants of an apparatus for pivoting a cover section 15 of a product carrier 11 with respect to a base section 13 connected thereto about a kink line 17 extending between the cover section 15 and the base section 13 in which at least one conveyor 85, in particular a conveyor belt, is provided on whose support surface the product carrier 11 can be conveyed along the conveying direction F with a cover section 15 disposed at the front or at the rear viewed in the conveying direction F. In addition, at least one pivot device 81 is provided having at least one active element 83 that is configured to grasp the cover section 15 at at least one of its two lateral margins. The active element 83 is movable, in particular pivotable, at least from a first position into a second position about the kink line 17 for pivoting the cover section 15.

The active element 83 can also be movable in the transverse direction to the conveying direction F for the grasping and release of the cover section 15 such that it can be moved away to the outside or can be brought into active connection or into engagement with the cover element 15 from late rally outside. The active element 83 can in this respect have a gripper by which the cover section 15 can be gripped.

The active element 83 can be moved along a part piece of the conveyor line with the product carrier 11 such that the pivoting of the cover section 15 can take place while the product carrier 11 is conveyed.

As is shown in the variant of FIG. 18, the active element 83 can be arranged at a separate conveyor 87, 89 that is arranged in parallel with and laterally beside the conveyor 85 for the product carriers 11 and that revolves. Two differently configured conveyors are shown on each side of the conveyor 85 in FIG. 18 for illustration purposes; the conveyor 87 at the right and the conveyor 89 at the left. It is understood that the same kind of conveyor is preferably arranged at both of the two sides.

The revolution speed of the respective separate conveyor 87, 89 can be adjustable relative to the revolution speed of the conveyor 85 for the product carriers 11. A plurality of active elements 83 that are arranged offset from one another along the conveyor 85, 87 are attached to each conveyor 85, 87. A respective active element 83 can take along and pivot a grasped cover section 15 of a product carrier 11 conveyed on the conveyor 85 by a suitable adjustment of the movement speed of the active elements 83 that is, for example, slightly above the conveying speed.

As FIG. 18 shows, the conveyor 87 comprises a conveyor belt 103 that revolves around two pulleys 99, 101 that are offset, viewed in the conveying direction F, and whose axis of rotation extends at least approximately perpendicular to the support surface for the product carriers 11. The upper side of the part of the conveyor belt 103 faces the conveyor 85 such that the active elements 83 attached to the upper side come into contact with the cover sections 15 and can pivot them, in particular when they are already slightly upwardly pivoted. The upper side of the part of the conveyor belt 103 running opposite to the conveying direction F is remote from the conveyor 85, whereby the active elements 83 can again be led back in the region of the total arrangement without them coming into contact with the cover sections 15.

The conveyor 89 likewise comprises a conveyor belt 91 that revolves around two pulleys that are offset, viewed in the conveying direction F, and whose axis of rotation extends at least approximately in parallel with the support surface for the product carriers 11 and perpendicular to the conveying direction F. The upwardly running part of the conveyor belt 91 is located at least a little above the support surface for the product carriers 11 while the downwardly running part 93 of the conveyor belt is disposed beneath the support surface. The active elements 83 project away from the conveyor belt 91 toward the side in the direction of the conveyor 85 for the product carriers 11, as FIG. 18 shows.

A respective active element 83 dips from below out of the support surface for the product carriers 11 at the end of the conveyor belt 91 at the rear, viewed in the conveying direction F, and moves from the bottom into contact with a cover section 15 of a product carrier 11. A pivoting of the cover section 15 takes place by the further movement of the active element 83 in the conveying direction F. At the front end of the conveyor belt 91, the respective active element 83 again dips downwardly away and is again transported back against the conveying direction F in a plane beneath the support surface for the product carriers 11.

As FIG. 19 shows, in a further modified variant, a plurality of active elements 83 can be arranged offset from one another over at least one section of the outer periphery of a rotary disk 97. The rotary disk 97 can be rotatable about an axis of rotation 95 disposed laterally next to the support surface or to the conveyor 85 and in particular adjustable in height and/or inclination angle such that the active elements 83 can be brought into operative connection with a respective cover section 15 by rotation about the axis of rotation 95.

Such pivoting devices 81 are arranged at both sides of the conveyor 85 for the product carriers 11 in the apparatus of FIG. 19. The size of the active region of an active element 83 can be set via the radius and via the kind of the rotary disk 97. The rotary disk 97 can in this respect be configured as an eccentric disk.

The active elements 83 can also e.g. be moved up and down in the manner of a rocker, for example by a pivotable suspension at the rotary disk 97. The movement can be effected by a control by a vertical contour on or at the rotary disk 95.

The axis of rotation 95 can optionally be adjustable in the horizontal direction, in particular also during operation. The axis of rotation 95 can also extend slightly obliquely to the vertical direction, whereby a good engagement beneath the cover sections 15 can be made possible. They are preferably slightly pre-folded. The slightly oblique axis of rotation 95 preferably has a right angle to a plane E (cf. FIG. 20 in which the pivoted cover sections 15 should lie after their pivoting. The same applies to simple downholder elements 105*a* that can be arranged along the conveyor line.

FIG. 20 shows the desired position of a cover section 15 after the pivoting and a plane E in which the pivoted cover section 15 is at least approximately disposed. The axis of rotation 95 extends at least approximately perpendicular to the plane E.

FIG. 21 shows an apparatus for pivoting a cover section 15 of a product carrier 11 with respect to a base section 13 connected thereto about a kink line 17 extending between the cover section 15 and the base section 13. The apparatus comprises at least one conveyor 105, in particular a conveyor belt, having a support surface for the product carrier 11. The apparatus comprises an element 107 arranged downstream of the conveyor 105, viewed in the conveying direction F, and has a support surface 109 for the product carrier 11, wherein the support surface 109 has a length, viewed along the conveying direction F, that substantially corresponds to the length of the base section 13, measured form the kink line 17 up to the edge of the base section 13 disposed remotely from the kink line 17. The support surface 109 is lowerable with respect to the support surface of the conveyor 105.

As FIG. 21 shows, provision is made that the product carrier 11 is conveyed onto the support surface 109 with a cover section 15 disposed at the rear, viewed in the conveying direction F, and with a product 25 disposed on the base section 13 such that at least a part of the cover section 15 is located above the conveyor 105*b*. When the support surface 109 is lowered and a falling of the product carrier 11 through the associated opening is permitted, the cover section 15 abuts the conveyor 105*b* and is pivoted by it about the kink line 17.

In addition, a folding apparatus (not shown) can be provided that, with a lowered support surface 109, further pivots the cover section 15, in particular until it comes into contact with the product 25.

FIG. 22 shows an apparatus for pivoting a cover section 15 of a product carrier 11 with respect to a base section 13 connected thereto about a kink line 17 extending between the cover section 15 and the base section 13. The apparatus comprises four short conveyors 111, in particular conveyor belts, having a support surface for a respective product carrier 11. The conveyors 111 are arranged rotatably in a rotational direction U about a horizontal axis of rotation 113 and indeed such that the alignment of the conveyors 111 at least does not substantially change.

In a first rotational position A, a respective conveyor 111 can take up a product carrier 11 that is provided by a feed, not shown, and comes to lie on the conveyor 111.

In a further, second rotational position B, that is arranged downstream of the first rotational position A, viewed in the rotational direction U, a respective conveyor 111 can take up a product 25, wherein the product 25 comes to lie on the base section 13 of the product carrier 11 taken up in the rotational position A. The product 25 can in this respect be delivered by means of a product feed 115.

When the respective conveyor 111 is rotated further in the rotational direction U from the second rotational position B, it moves past a pivoting device 117 that pivots the cover section 15 of the product carrier 11 about the kink line 17. The pivot device 117 can in this respect comprise at least one active element 119 that can be moved from radially outside into the movement path of the cover section 15 and can thus be brought into operative connection with the cover section 15. The active element 119 can, however, also be attached in a fixed position and has a corresponding association with the movement path of the cover section 15.

In a further, third rotational position C of the respective conveyor 111 serving for the transfer, a conveying device 121 is arranged downstream of the conveyor 111 by means of which the product carrier 11 can be transported off together with the product 25 and the pivoted product section 15 disposed thereon.

The selected number of four conveyors 111 is arbitrary. More or fewer than four conveyors 111 can also be provided.

FIG. 23 serves for the illustration of the idea that a product carrier 11 with a product 25 and a pivoted cover section 15 is introduced into a packaging upside down, that is with the product carrier 11 disposed at the top. The cover section 15 thereby remains fixed. A flipping apparatus can be provided before the introduction into the packaging that flips the product carrier 11 together with the product 25, that is arranges them upside down.

REFERENCE NUMERAL LIST

11 product carrier
13 base section
15 cover section
17 kink line
19 pre-treatment device, folding rail
21 first conveyor
23 second conveyor
25 product
27 conveyor
29 conveyor band
31 active element
33 suction rail
35 second conveyor
37 gap
39 abutment
41 third conveyor
43 conveyor

45 folding element
47 feed
49 conveyor
51 feed
53 folding element
55 product feed
57 first conveyor
59 pivoting device
61 second conveyor
63 third conveyor
65 first conveyor
67 second conveyor
69 third conveyor
71 metal sheet
73 first conveyor
75 second conveyor
77 gap
79 feed
81 pivoting device
83 active element
85 conveyor
87 conveyor
89 conveyor
91 conveyor belt
93 conveyor belt part
95 axis of rotation
97 rotary disk
99 pulley
101 pulley
103 conveyor belt
105 conveyor
105*a* downholder element
105*b* conveyor
107 element
109 support surface
111 conveyor
113 axis of rotation
115 product feed
117 pivoting device
119 active element
121 conveying device
F conveying direction
P arrow direction
Q arrow
R arrow
S pivot axis
E plane
U rotational direction
A first rotational position
B second rotational position
C third rotational position

The invention claimed is:

1. An apparatus for pivoting a cover section (15) of a product carrier (11) with respect to a base section (13) of the product carrier (11), about a kink line (17) of the product carrier (11) extending between the cover section (15) and the base section (13) of the product carrier (11), wherein the apparatus comprises:

at least one conveyor (27) having a support surface on which the product carrier (11) can be conveyed in a conveying direction (F); and a pivoting device having at least one active element (31), wherein the active element (31) is configured and arranged, for the pivoting of the cover section (15) of the product carrier (11) disposed on the support surface, to cooperate with the cover section (15) from below the support surface, wherein the support surface of the at least one conveyor (27) is provided by bands (29) spaced from one another by gaps, wherein the active element (31) includes a plurality of levers configured to extend upwardly above the support surface through the gaps, between the bands of the support surface, to pivot the cover section (15) about the kink line (17).

2. An apparatus in accordance with claim 1, wherein a suction rail (33) extending transversely to the conveying direction (F) is provided that grasps the base section (13) from below the support surface.

3. An apparatus in accordance with claim 1, wherein the plurality of levers of the active element (31) are arranged in a row extending transversely to the conveying direction (F), with the plurality of levers of the active element (31) being moveable along the conveying direction (F) with the product carrier (11) while pivoting the cover section (15) about the kink line (17).

4. An apparatus in accordance with claim 1, wherein the plurality of levers of the active element (31) are configured to move downwardly through the gaps to a position beneath the support surface upon completion of pivoting the cover section (15) and to move opposite the conveying direction (F) to a start of the at least one conveyor (27) to perform pivoting of a cover section (15) of a subsequent product carrier (11).

5. An apparatus for pivoting a cover section (15) of a product carrier (11) with respect to a base section (13) of the product carrier (11), about a kink line (17) of the product carrier (11) extending between the cover section (15) and the base section (13) of the product carrier (11), wherein the apparatus comprises:

at least one conveyor (27) having a support surface on which the product carrier (11) can be conveyed in a conveying direction (F), and a pivoting device having at least one active element (31), wherein the active element (31) is configured and arranged, for the pivoting of the cover section (15) of the product carrier (11) disposed on the support surface, to cooperate with the cover section (15) from below the support surface, wherein a suction rail (33) extending transversely to the conveying direction (F) is provided that grasps the base section (13) from below the support surface, wherein the support surface of the at least one conveyor (27) is provided by bands (29) spaced from one another by gaps, wherein the active element (31) includes a plurality of levers configured to extend upwardly above the support surface through the gaps, between the bands of the support surface, to pivot the cover section (15) about the kink line (17), wherein the plurality of levers of the active element (31) are arranged in a row extending transversely to the conveying direction (F), with the plurality of levers of the active element (31) extending from the suction rail (33) and being moveable along the conveying direction (F) with the product carrier (11) while pivoting the cover section (15) about the kink line (17).

* * * * *